US007464424B1

(12) United States Patent
Formica et al.

(10) Patent No.: US 7,464,424 B1
(45) Date of Patent: Dec. 16, 2008

(54) GIDDY BABY RELAXER

(76) Inventors: Marilyn Formica, 623 Hudson Ave., Pitman, NJ (US) 08071; Charles J. Formica, 623 Hudson Ave., Pitman, NJ (US) 08071

( * ) Notice: Subject to any disclaimer, the term of this patent is extended or adjusted under 35 U.S.C. 154(b) by 0 days.

(21) Appl. No.: 11/906,943

(22) Filed: Oct. 4, 2007

Related U.S. Application Data

(60) Provisional application No. 60/927,981, filed on May 7, 2007.

(51) Int. Cl.
*A47D 13/08* (2006.01)
*A47D 15/00* (2006.01)
*A61H 1/00* (2006.01)

(52) U.S. Cl. ..... 5/655; 5/904; 5/915; 297/452.13

(58) Field of Classification Search ..... 5/655, 5/639–641, 904, 915; 297/452.13
See application file for complete search history.

(56) References Cited

U.S. PATENT DOCUMENTS 2,848,040 A * 8/1958 Chernivsky ..... 297/296
2,961,668 A * 11/1960 Hayes ..... 5/640
3,235,306 A * 2/1966 Chernivsky ..... 297/296
3,840,916 A * 10/1974 Jennings ..... 5/655
4,197,604 A * 4/1980 Nakamura ..... 5/640
4,227,270 A * 10/1980 Rivera ..... 5/639
4,538,310 A * 9/1985 Scott ..... 5/655
4,606,087 A * 8/1986 Alivizatos ..... 5/424
4,776,546 A * 10/1988 Goldson et al. ..... 248/102
4,790,042 A * 12/1988 Reich ..... 5/655
4,965,888 A * 10/1990 Jones ..... 2/104
5,086,517 A * 2/1992 Jones ..... 2/104
5,269,591 A * 12/1993 Miga et al. ..... 297/452.13
5,360,258 A * 11/1994 Alivizatos ..... 297/440.11
5,460,430 A * 10/1995 Miga et al. ..... 297/452.13
5,700,059 A * 12/1997 Moscot ..... 297/452.17
5,933,886 A * 8/1999 Washington ..... 5/494
5,950,261 A * 9/1999 Hay et al. ..... 5/482
6,175,981 B1 * 1/2001 Lizama et al. ..... 5/655
7,107,639 B2 * 9/2006 Taricani ..... 5/655
7,386,902 B2 * 6/2008 Wilson ..... 5/655
2005/0278854 A1 * 12/2005 Taricani ..... 5/655
2007/0074348 A1 * 4/2007 Carlton ..... 5/639
2007/0101502 A1 * 5/2007 Bierbauer ..... 5/636
2007/0220675 A1 * 9/2007 Haskins et al. ..... 5/485
2008/0178387 A1 * 7/2008 Kachtick-Anders ..... 5/603

* cited by examiner

*Primary Examiner*—Robert G Santos

(57) ABSTRACT

A giddy baby relaxer that is in the form of a woman's upper body. A baby holder in the front with arms and folding hands. The base stand consists of two attached extensive legs with locks, with an adjustable knob on both sides of the body of the baby relaxer. The rear of the upper body of the giddy baby relaxer embodies the heartbeat, breathing, vibrating and CD player. These are operable with a remote control. The rear of the body of the giddy baby relaxer is equipped for safety straps to allow for optional transporting in an automobile.

5 Claims, 7 Drawing Sheets

GIDDY BABY RELAXER

CROSS-REFERENCE TO RELATED APPLICATIONS

This application claims the benefits of provisional patent application Ser. Nos. 60/927,981, filed May 7, 2007

FEDERALLY SPONSORED RESEARCH

NOT APPLICABLE

SEQUENCE LISTING OR PROGRAM

NOT APPLICABLE

BACKGROUND OF THE INVENTION

1. Field of Invention

This invention relates to an updated, modified 20$^{th}$ Century baby relaxer that will change the way mothers and caregivers will be able to comfort any baby. It will benefit the fussy and happy baby with the comfort and warmth of being held by a real mother.

2. Prior Art

The prior art of baby sit holders has not addressed the issue of allowing the child to feel the comfort of a protective body, loving arms, soothing breathing, a restful heart beat and music that will stimulate the mind. This invention solves the problem of allowing the mother or caretaker to perform other duties while the child is being comforted.

U.S. Pat. No. 7,168,600 B2 this prior art is designed for the baby to be carried at all times by someone on his or her back. This becomes strenuous after a period of time. You are not able to quickly aid the child due to lack of eye contact. The baby is wrapped in fabric, while the giddy baby relaxer wraps the child up in loving arms.

U.S. Pat. Nos. 6,712,382 B2 this prior art lacks the comfort and support that any baby would desire when lying close to a woman's upper body. This art also presents a sturdy seat and back rest which again lacks the comfort and natural alignment of a mother's upper body. The Formica invention would allow the child to be placed in front or back position and still have the assurance of a mother's comfort and protection. The child would also be able to partake of daily activities while in the giddy baby relaxer.

U.S. Pat. Nos. 5,934,528 prior art lacks the freedom and mobility that would allow the individual carrying the baby to have. This would put stress on the body after a long period of time. The carrier would spend a lot of time preoccupied by the baby's needs. The Formica invention would allow the baby close comfort of women's upper body and music or learning materials to stimulate growth. The Formica invention allows for a perfume pouch for mother's own scent, for the smelling sense that babies have for parents. The invention solves the problem of security, protection and comfort by the loving arms that are wrapped around the baby. This invention is intended for the fussy, difficult and unsettled babies that need one to one support or care. This invention is ideal for families with multiple small children.

The benefit of this invention is that it can function in a variety of ways and places. It can be instrumental in a hospital, home, park, and school just to name a few. This invention stores easily in a closet or trunk of a car.

This present invention can be made of multiple materials to give it a sleek style and appearance. The relaxer is mounted on a sturdy durable metal frame to support the weight of a young growing baby. This invention also allows for a baby bottle to be held in either breast for feeding.

OBJECTS AND ADVANTAGES

Accordingly, besides the objectives and advantages of the baby relaxer described in my above patent, several objectives and advantages of the present invention are:

A. to provide a sleek, lightweight, comfortable relaxer for any baby needs.

B. to provide a CD player, which allows the baby to hear sound for mind stimulation.

C. to provide a soothing heart beat that will give contentment, pleasure and rest to any baby's needs.

D. to provide an adjustable back for comfort and support.

E. to allow for easy cleaning of the fabric covering that can be made of soft natural cotton, hypoallergenic material.

F. to provide a breathing mechanism that will give the baby the feeling of being close to a mother's body.

G. the addition of a mother's scent spray or pouch, to provide close connection with mother and baby.

H. to provide battery pack with optional voltage to get best duration of time and strength.

I. to provide a hand held remote control for easy adjustment of features.

J. to provide safety straps and protective arms for support and security.

K. the additional extensive legs to permit supplemental space for babies hanging legs. Still further objectives and advantages will become apparent from a consideration of the ensuing description and drawings.

L. to provide assistance in feeding of a baby with easy bottle holder in the breasts of the giddy baby relaxer.

SUMMARY

In accordance with the present invention, the Giddy Baby Relaxer. The main advantages of this invention is to provide a new way that mothers and caretakers will be able to comfort any baby. This will allow them to focus on other matters that need to be addressed. This invention will be in the form of a woman's upper body. Babies require a lot of attention and will cry if not attended too. This invention solves that problem, giving them soothing sounds, a scent of a mother, calm breathing, a soothing heartbeat and comforting pats on the back. This is all to ensure continual quality care of the baby.

Further objective is that a remote control is available to change the motion of movement for a changing baby's needs.

BRIEF DESCRIPTIONS—FIGURES

In the drawings, the invention will be described with the illustration of the reference.

Figure 1:
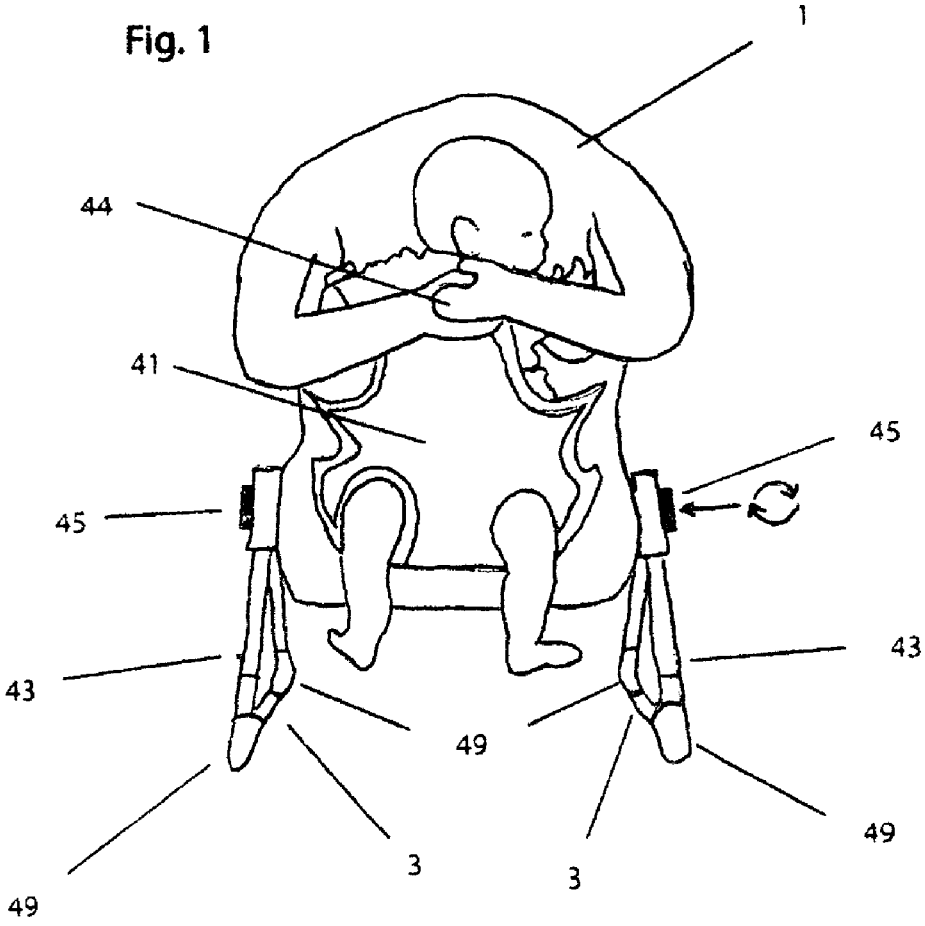
FIG. 1 shows a front view of the embodiment of the inventive giddy baby relaxer.

| Drawing-Reference Numerals |
|---|
| 01. Body of Giddy Baby Relaxer |
| 03. Base Stand |
| 11. Scent Pouch |
| 13. CD Player |
| 19. Breathing/Vibrating |
| 21. Remote Control |
| 23. Battery Pack |
| 27. CD |
| 29. Buckle |
| 31. Safety Straps |
| 33. Bottle Holder |
| 14. Speaker |
| 15. Heartbeat |
| 17. Slits |
| 18. Lower Slits |
| 41. Giddy "Baby" Holder |
| 43. Extensive legs with lock |
| 44. Folding Hands |
| 45. Adjustable knobs |
| 49. Support cushions |
| 51. Automobile Car Seat Belt |
| 53. Slit for baby bottle |

DETAILED DESCRIPTION OF THE PREFERRED EMBODIMENT

Looking specifically at FIG. 1 it can be seen that the female body is the form of the giddy baby relaxer 1. The giddy "baby" holder 41 is shown holding an infant. The folding hands 44 are supportive loving arms for the baby being held in the giddy baby holder 41. The base stand 3 is protected at each adjacent corner with protective cushion 49 that also allows for safe closure. The extensive legs with locks 43 allows for growth and size adjustment. This is connected to the adjustable knob 45 that will allow rotation of the giddy baby holder 1.

Figure 2:
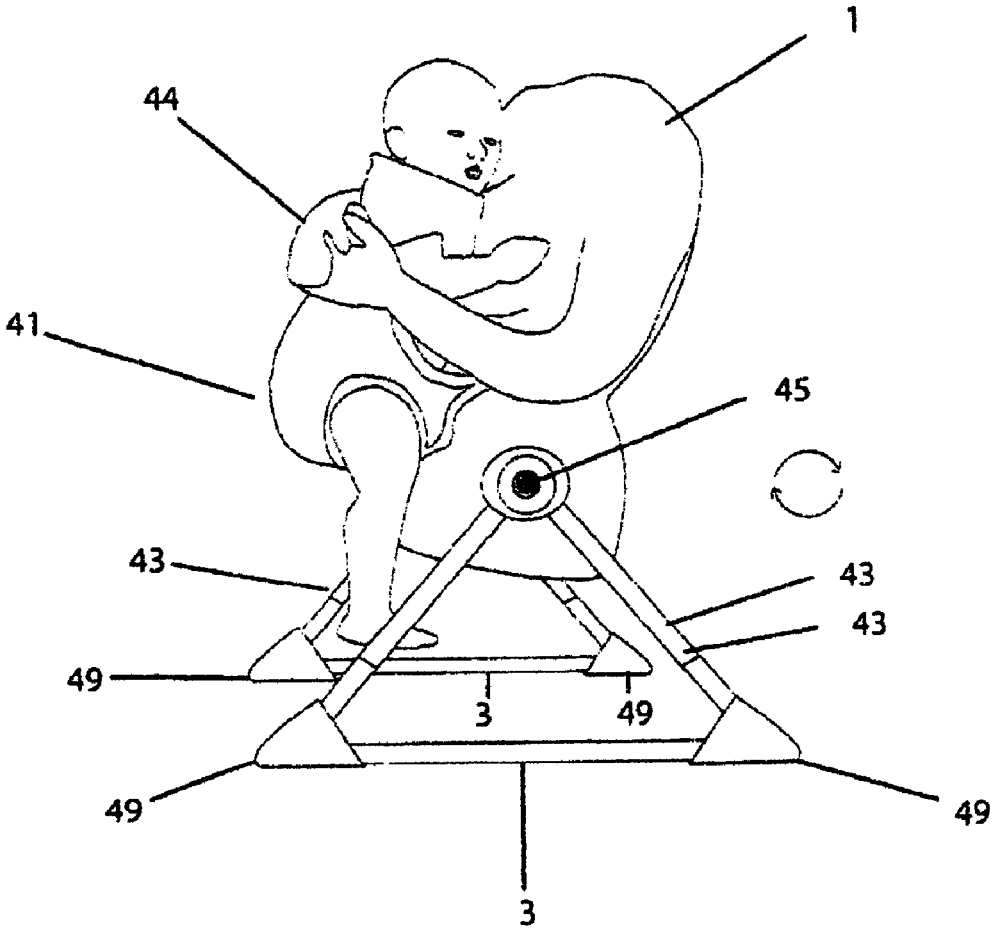
FIG. 2 shows a left-side view of the giddy baby relaxer of FIG. 1.

FIG. 2 is a drawing of the giddy baby relaxer 1 side view with the folding hands 44 across the upper back of the giddy baby holder 41. The stand 3 provides weight support while the baby is relaxing in the holder 41. The adjustable knobs 45 give the positional option for angling the baby. The extensive legs with locks 43 ensure equal balance of the base stand 3.

Figure 3:
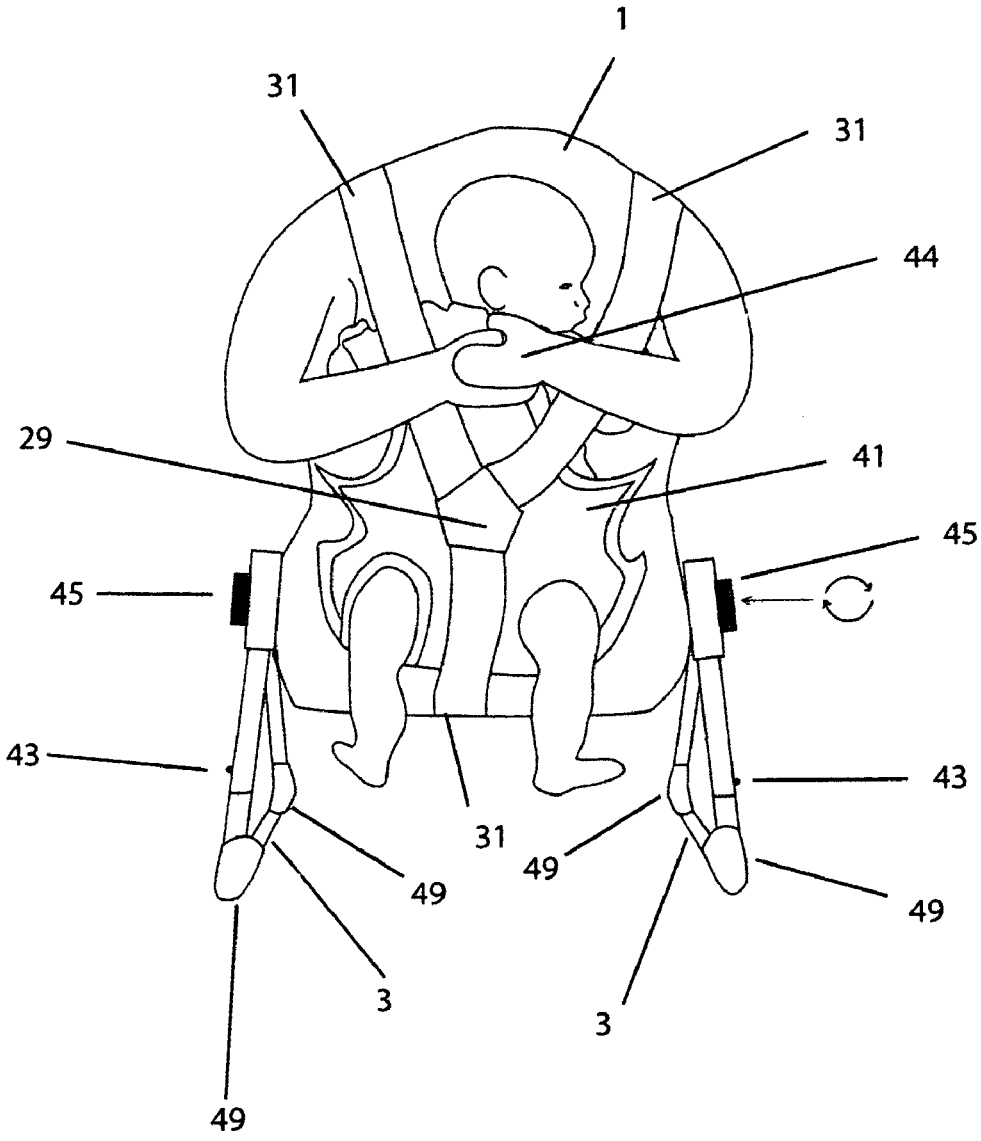
FIG. 3 shows a frontal view with safety straps of the giddy baby relaxer embodiment.

Looking at FIG. 3 the giddy baby relaxer 1 has safety straps 31 over both shoulders of the giddy baby relaxer 1 and a safety strap between the legs of the baby inside of the giddy baby holder 41. The buckle 29 is to lock and secure the infant in place while in the giddy baby holder 41. The base stand 3 is to support the weight of the infant, while the extensive legs with locks 43 can be upper or lower to secure stationary position.

Figure 4:
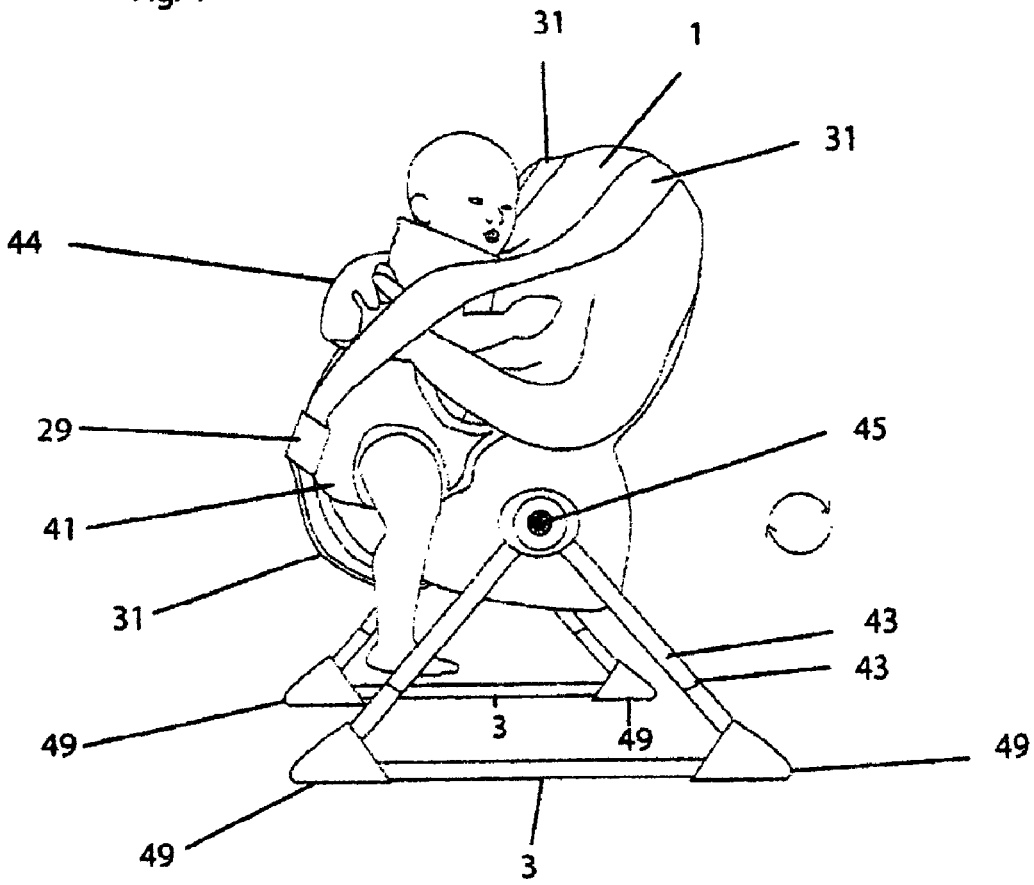
FIG. 4 is a perspective view of the giddy baby relaxer showing its safety straps of FIG. 3.

The support cushion 49 gives grip to assist in keeping the giddy baby relaxer in place. The rotation of the adjustable knob 45 is to give the baby comfort in different positions. Looking more specifically at FIG. 4 it can be seen that the safety straps 31 on the giddy baby relaxer 1 are provided to ensure protection for the baby in any travel or stationary position. The safety straps 31 allows for the flexibility of movement for the baby and the buckle 29 to provide lock-in protection. The giddy baby holder 41 along with the safety straps 31 is for security. See FIG. 1 for base stand 3 and support cushions 49. The folding hands 44 to supply reinforcement to the giddy baby holder 41.

Figure 5:
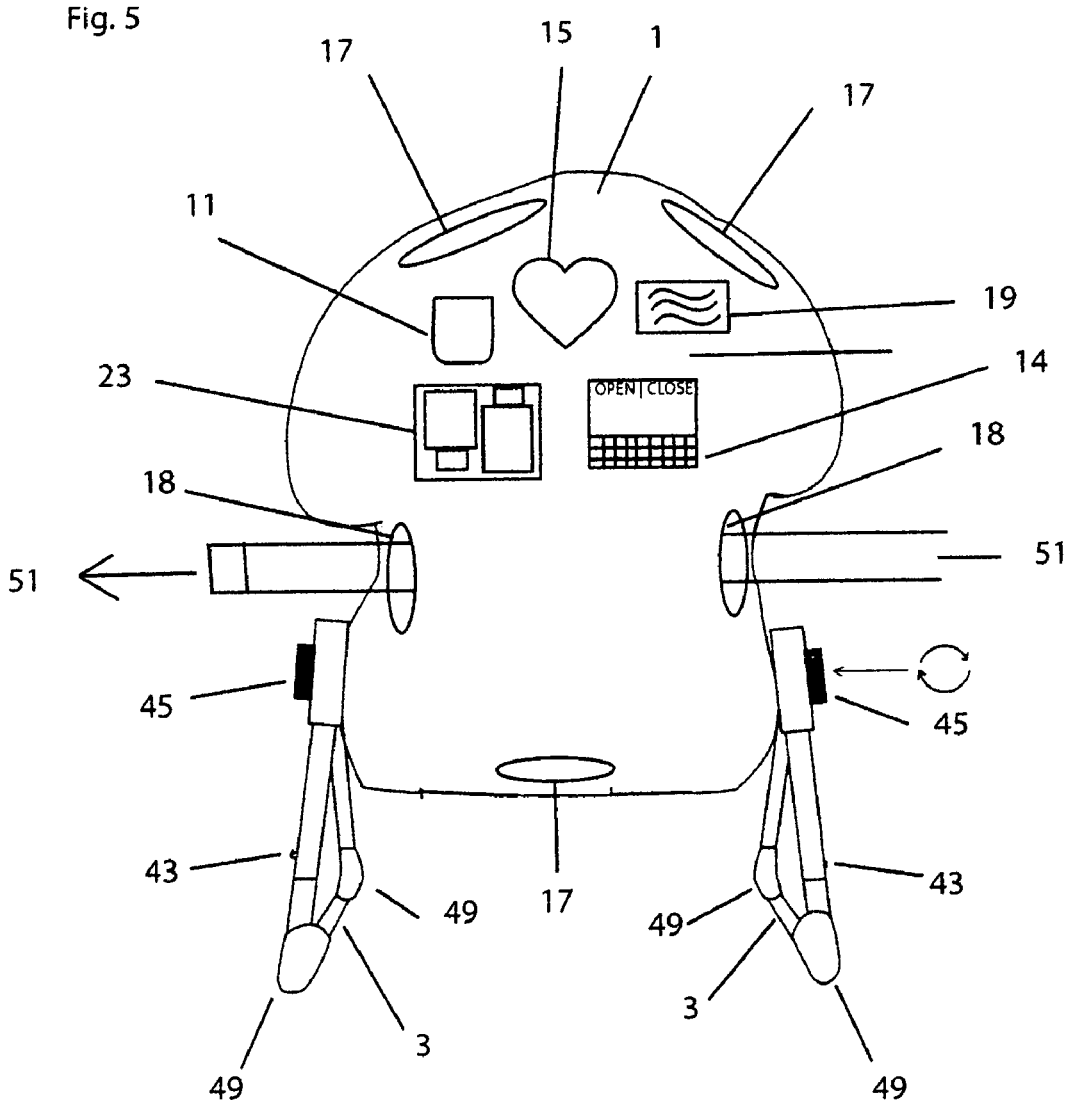
FIG. 5 is the back view of the giddy baby relaxer of all the above FIGS. 1, 2, 3 and 4.

FIG. 5 is a drawing of the back view of the giddy baby relaxer 1. It has the slits 17 opening for the safety straps 31 that can be attached to secure baby in the front of the giddy baby holder 41, see FIG. 1. FIG. 5 the giddy baby relaxer 1 has a scent pouch 11 to hold perfume. The CD player 13 to give soothing sounds to the infant in the giddy baby relaxer 1. The speaker 14 to give outgoing sound of the CD player 13. The battery pack 23 is for charging the features on the giddy baby relaxer 1. The heartbeat 15 to give the infant in the giddy baby holder the assurance that the mother is close as the child's head rests securely in the upper body of the giddy baby holder 41, see FIG. 2.

The breathing/vibrating 19 is to give comfort for the baby in the giddy baby relaxer 1, see FIG. 1. The automobile seat belt 51 goes through slits 18 to secure giddy baby relaxer 1 to back seat of car. The extensive legs with locks 43 should be at lowest point. The adjustable knob 45 should be in upright position for baby safety while in the giddy baby holder 41, see FIG. 3. The slits behind each breast 53. The baby bottle 33 goes into the inside of the breast 53 to hold the bottle 33

Figure 6:
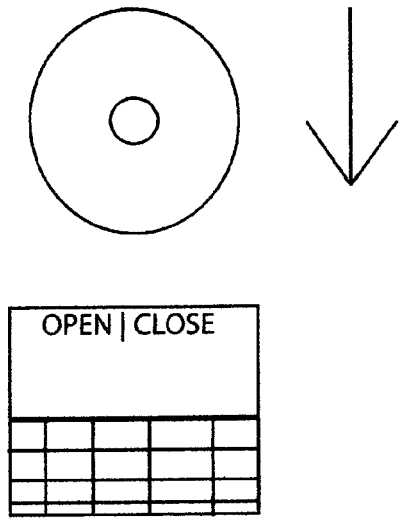
FIG. 6 shows a front view of a CD player and cassette.

FIG. 6 the drawing of the CD player 13 and speaker 14, which will permit a disc to play and release sound through the speaker 14.

Figure 7:
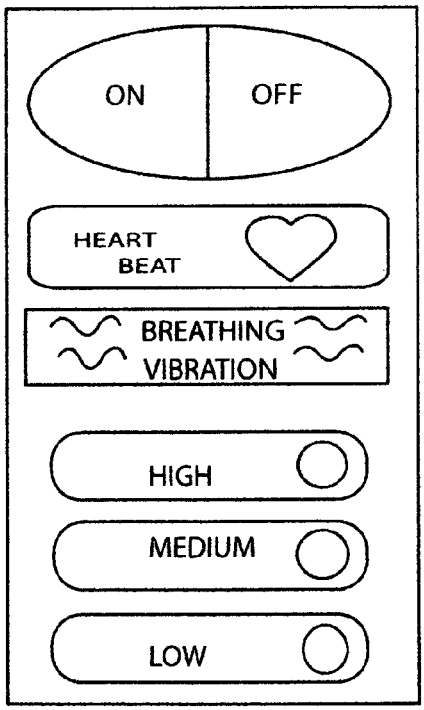
FIG. 7 shows a front view of a hand remote control.

FIG. 7 is the drawing of the remote control 21 that automate the features on the giddy baby relaxer 1, see FIG. 5.

Figure 8:
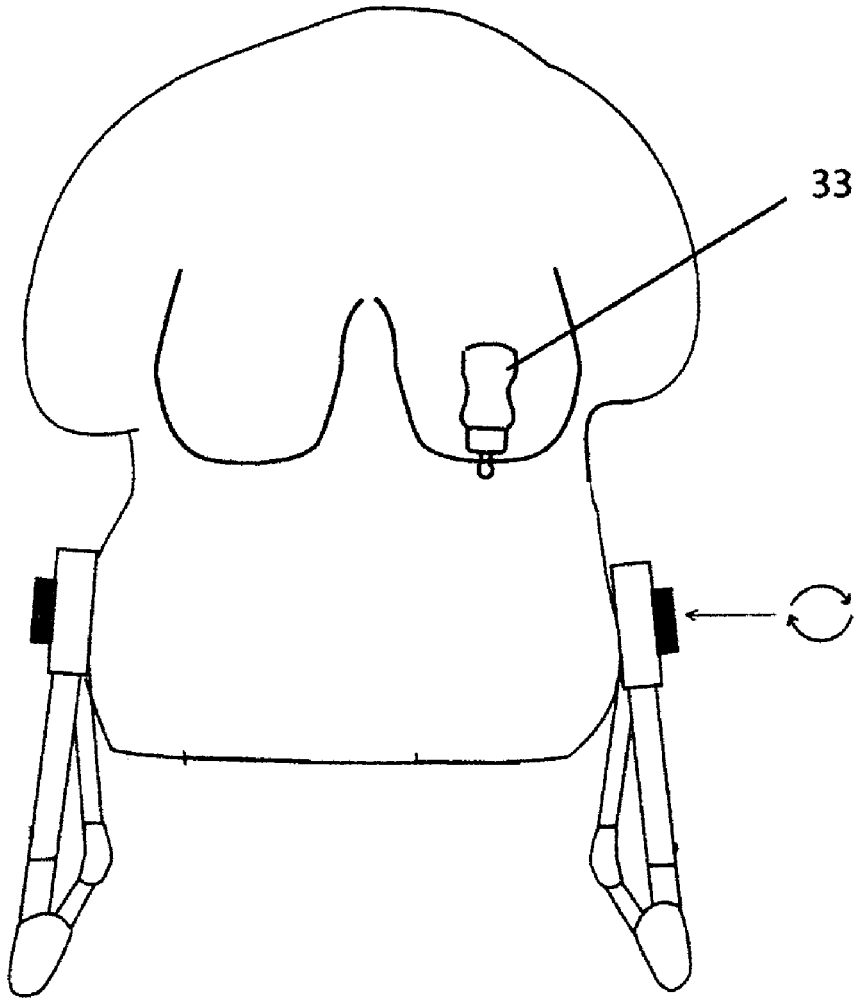
FIG. 8 shows a front view of a baby bottle in the breast of the giddy baby relaxer.

FIG. 8 shows the baby bottle 33 in position.

CONCLUSION, RAMIFICATIONS AND SCOPE

Accordingly, this reader will see that the giddy baby relaxer has these advantages:

It can provide comfort to all types of baby's issues.

It breasts can hold a baby bottle to assist with feeding.

It is power to function on batteries to keep cost down.

It can be made of various materials.

It provides remote for features to calm and comfort a baby.

There are safety straps to ensue protection for the baby.

Although the description above contains many specificities, these should not be construed as limiting the scope of the invention but as merely providing illustrations of some of the presently preferred embodiments of the invention. For example, the adjustable knob can have other shapes, such as oval, square, etc.; the folding hands can extend to cross at the arms, etc.

Thus the scope of the invention should be determined by the appended claims, rather than by the examples given.

What is claimed is:

1. A baby relaxer for providing a new way mothers and caretakers will be able to comfort any baby, the baby relaxer comprising:

a main body in the form of a woman's upper body having a front surface with a pair of soft full size breasts disposed thereon;

a base stand supporting the main body of said baby relaxer, said base stand having a pair of spaced apart extensive side legs with a lock on each side leg;

adjustable knobs operatively connected to both side legs for selective angular positional reclining of said base stand;

a baby holder disposed on the front surface of the main body for holding an infant close to said pair of breasts, said baby holder including an outer surface facing away from the front surface of the main body;

detachable safety straps extending downwardly from a top edge of the main body and extending upwardly from a bottom edge of the main body, said safety straps including a buckle that locks the safety straps across the front surface of the main body and over the outer surface of the baby holder to lock and secure the infant in place while in the baby holder; and a pair of folding hands extending from opposed upper side portions of the main body, across the front surface of the main body and over said baby holder and detachable safety straps to provide additional support and security for the infant when placed inside the baby holder.

2. A baby relaxer according to claim 1, further comprising lower slits formed in a rear surface of the main body of the baby relaxer to accommodate an automobile seat belt.

3. A baby relaxer according to claim 1, further comprising a CD player with speakers and a breathing and vibrating mechanism operatively connected to the main body; and a remote control for adjusting the volume of the CD player and for controlling said breathing and vibrating mechanism.

4. A baby relaxer according to claim 1 further comprising a heart beat mechanism on the body of the baby relaxer; a remote control for controlling said heart beat mechanism on the body of the baby relaxer; and a scent pouch formed in a rear surface of the main body of said baby relaxer.

5. A baby relaxer according to claim 1, further comprising a bottle holder that is built into each of said breasts.

* * * * *